United States Patent [19]

Otani

[11] Patent Number: 4,575,310

[45] Date of Patent: Mar. 11, 1986

[54] PROPELLER SHOCK ABSORBER FOR MARINE PROPULSION DEVICE

[75] Inventor: Hiroaki Otani, Shizuoka, Japan

[73] Assignee: Sanshin Kogyo Kabushiki Kaisha, Hamamatsu, Japan

[21] Appl. No.: 589,955

[22] Filed: Mar. 15, 1984

[30] Foreign Application Priority Data

Mar. 17, 1983 [JP] Japan ..... 58-43127

[51] Int. Cl.[4] ..... B63H 1/20

[52] U.S. Cl. ..... 416/134 R; 416/93 A; 416/133; 416/169 R

[58] Field of Search ..... 416/134 R, 133, 93 A, 416/169 R, 169 C; 464/83, 85, 89, 91, 92; 403/227, 225, 226

[56] References Cited

U.S. PATENT DOCUMENTS

| | | | |
|---|---|---|---|
| 2,164,485 | 7/1939 | Yantis | 416/169 C X |
| 2,235,605 | 3/1941 | Bugatti | 416/169 C X |
| 2,751,987 | 6/1956 | Kiekhaefer | 416/244 B X |
| 3,047,074 | 7/1962 | Rielag | 416/134 R X |
| 3,084,852 | 4/1963 | Seavey | 416/134 R |
| 3,321,024 | 5/1967 | Marconi | 416/169 C X |
| 3,335,803 | 8/1967 | Van Ranst | 416/169 C |
| 3,754,837 | 8/1973 | Shimanckas | 416/134 R X |
| 3,865,510 | 2/1975 | Yoshino | 416/134 R |
| 3,871,324 | 3/1975 | Snyder | 416/93 A X |
| 4,338,064 | 7/1982 | Carmel | 416/134 R |
| 4,486,181 | 12/1984 | Cavil | 440/49 |

FOREIGN PATENT DOCUMENTS

| | | | |
|---|---|---|---|
| 497790 | 11/1937 | United Kingdom | 416/134 R |
| 586035 | 1/1978 | U.S.S.R. | 416/134 R |
| 785114 | 12/1980 | U.S.S.R. | 416/134 R |

*Primary Examiner*—Everette A. Powell, Jr.
*Attorney, Agent, or Firm*—Ernest A. Beutler

[57] ABSTRACT

Several embodiments of coupling arrangements for resiliently coupling a propeller to a driving shaft. In each embodiment, a first resilient means provides a resilient coupling for absorbing circumferential vibrations and a second resilient means for absorbing axial vibrations. In one embodiment of the invention, one of the resilient means comprises a coil spring. In the other embodiment, all of the resilient means comprise elastomeric sleeves. In a further embodiment of the invention, axial damping in both forward and reverse directions are provided.

15 Claims, 3 Drawing Figures

PROPELLER SHOCK ABSORBER FOR MARINE PROPULSION DEVICE

BACKGROUND OF THE INVENTION

This invention relates to a propeller shock absorber for a marine propulsion device and more particularly to an improved resilient cushioning means interposed between the propeller and its driving shaft.

It is well known to employ elastomeric sleeves between the hub of a propeller and the driving shaft so as to absorb tortional vibrations in the propeller. However, there are also axial vibrations present which are not absorbed with conventional mechanisms. If the elastomeric sleeve provides any axial dampening, it is relatively insignificant since the hub of the propeller normally engages a thrust sleeve so as to transmit the driving thrust from the propeller to the lower unit. Hence, vibrations are not absorbed by conventional mechanisms and undesirable vibrations may be transmitted to the occupants of the water craft as well as causing possible other adverse effects.

It is, therefore, a principal object of this invention to provide an improved propeller shock absorbing arrangement for a marine propulsion device.

It is a further object of this invention to provide an improved and simplified arrangement for absorbing both circumferential and axial vibrations between a propeller and its driving shaft.

SUMMARY OF THE INVENTION

This invention is adapted to be embodied in a coupling arrangement for resiliently coupling a propeller in a driving shaft. The coupling arrangement comprises first resilient means for providing a resilient connection in a circumferential direction between the propeller and the driving shaft. Second resilient means provide a driving connection between the propeller in the driving shaft in an axial direction.

DETAILED DESCRIPTION OF THE PREFERRED EMBODIMENTS OF THE INVENTION

Figure 1:
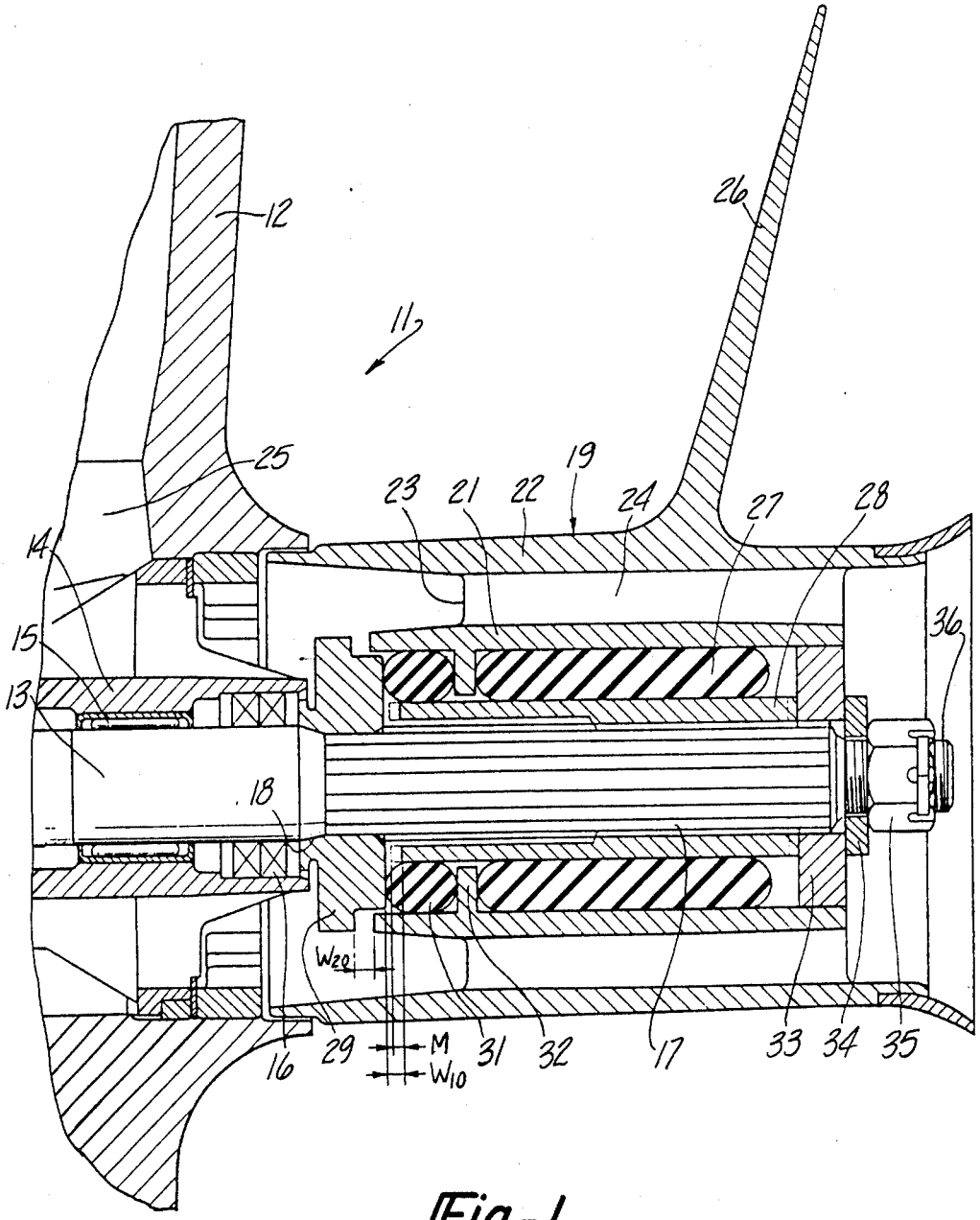
FIG. 1 is a cross-sectional view taken through the lower unit of an outboard drive and specifically the propeller mechanism showing a coupling arrangement constructed in accordance with a first embodiment of the invention.

Referring first to FIG. 1, a lower unit of an outboard drive constructed in accordance with the invention is identified generally by the reference numeral 11. The outboard drive 11 may constitute the lower unit of an outboard motor or the lower unit of the outboard drive section of an inboard outboard drive. Since the invention relates to the manner in which the propeller is coupled to the drive shaft, only this portion of the structure has been shown in detail and will be described.

The lower unit comprises a casing 12 in which a drive shaft 13 is rotatably supported, by means such as a bearing housing 14 and bearing 15. The drive shaft 13 is driven in any known manner and extends through an oil seal 16 formed at the rear end of the bearing housing 12 and projects rearwardly beyond the end of the lower unit. The projecting portion of the drive shaft is externally splined, as at 17 with a tapered thrust surface 18 being formed adjacent the forward ends of the splines.

A propeller assembly, indicated generally by the reference numeral 19, is coupled to the splines 17 and drive shaft 13 in a manner now to be described. The propeller assembly 19 includes a hub consisting of an inner hub member 21 and an outer hub member 22 that are connected to each other by means of a plurality of circumferentially spaced radially entending ribs 23. The ribs 23 and spacing between the hub members 21 and 22 provides a plurality of axially extending passages 24 that may receive and pass exhaust gases which are transmitted to the lower unit 12 through an exhaust gas passage 25 formed therein. As will become apparent, the invention is not limited to propeller mechanisms having through the hub exhaust.

A plurality of blades, only one of which appears in the drawings, 26 extend radially outwardly from the outer hub member 22. The blades 26 hub members 22 and 21 and ribs 23 may be conveniently formed integrally with each other, as by casting or the like.

A first elastomeric sleeve 27 is received in an inner bore of the inner hub 21. The sleeve 27 may be affixed to the hub member 21 by means of a shrink fit or the like. The inner periphery of the sleeve 27 is affixed to the outer periphery of an inner sleeve 28 in a suitable manner as by adhesive bonding. The inner sleeve 28 is internally splined so as to couple the inner sleeve 28 to the drive shaft splines 17. Hence, the elastomeric sleeve 27 provides damping in a circumferential direction and also rotatably couples the propeller 19 to the drive shaft 17 in a circumferential direction.

A thrust member in the form of an annular washer 29 has a tapered inner bore that is engaged with the tapered thrust surface 18 of the drive shaft 13. Normally the thrust member 29 is directly engaged by the propeller hub so as to provide a thrust transmission between the propeller and the lower unit. Such direct mechanical connections, however, afford no damping. In accordance with the invention, the forward end of the inner sleeve 28 is spaced from the thrust member 29 by a dimension $W_{10}$. In a like manner, the inner hub member 21 of the propeller is spaced from the thrust member 29 by a dimension $W_{20}$. An elastomeric member 31 is interposed between the thrust member 29 and a radially inwardly extending annular shoulder 32 formed on the inner hub member 21 of the propeller 19. When not compressed, the elastomeric member 31 maintains the spacings $W_{10}$ and $W_{20}$.

The propeller 19 is maintained on the drive shaft 13 and rearward drive thrusts are taken by a second thrust member 33 that is engaged with the rear end of the inner sleeve 28 and which is held axially in place by means of a washer 34 and nut 35 that is threaded onto a threaded rear end 36 of the drive shaft 13.

The elastomeric member 31 is more resilient than the elastomeric member 27 in an axial direction. When the propeller 19 is driving the associated water craft in a forward direction with a relatively low thrust, the elastomeric member 31 will be compressed between the flange 32 and the thrust member 29. If the forces are relatively low, the degree of compression with be as indicated by the dimension M, which is less than the dimensions $W_{10}$ and $W_{20}$ and the elastomeric member 31 will provide damping in a forward axial direction. Hence, uneven driving thrust resulted by the passage of the blades 26 through the water will be readily isolated from the associated water craft. If sufficient driving force is encountered, however, so as to take up the clearances $W_{10}$ or $W_{10}$, which ever is lesser, either the inner sleeve 28 or the inner hub member 21 will engage the thrust taking member 29 and provide a direct mechanical connection in the forward direction so as to insure adequate driving force. Under these circumstances, no additional damping in the axial direction will be provided. It should be readily apparent that either of the dimensions $W_{10}$ or $W_{20}$ may be selected to be the lesser of the two so that the relative axial force transmission will be through the respective sleeve. Alternatively, the dimensions $W_{10}$ and $W_{20}$ may be made the same so that both the inner sleeve 28 and the inner hub member 21 will transmit axial thrust from the propeller 19 to the water craft.

It should be readily apparent that there is no axial damping in this embodiment when driving in the reverse direction.

Figure 2:
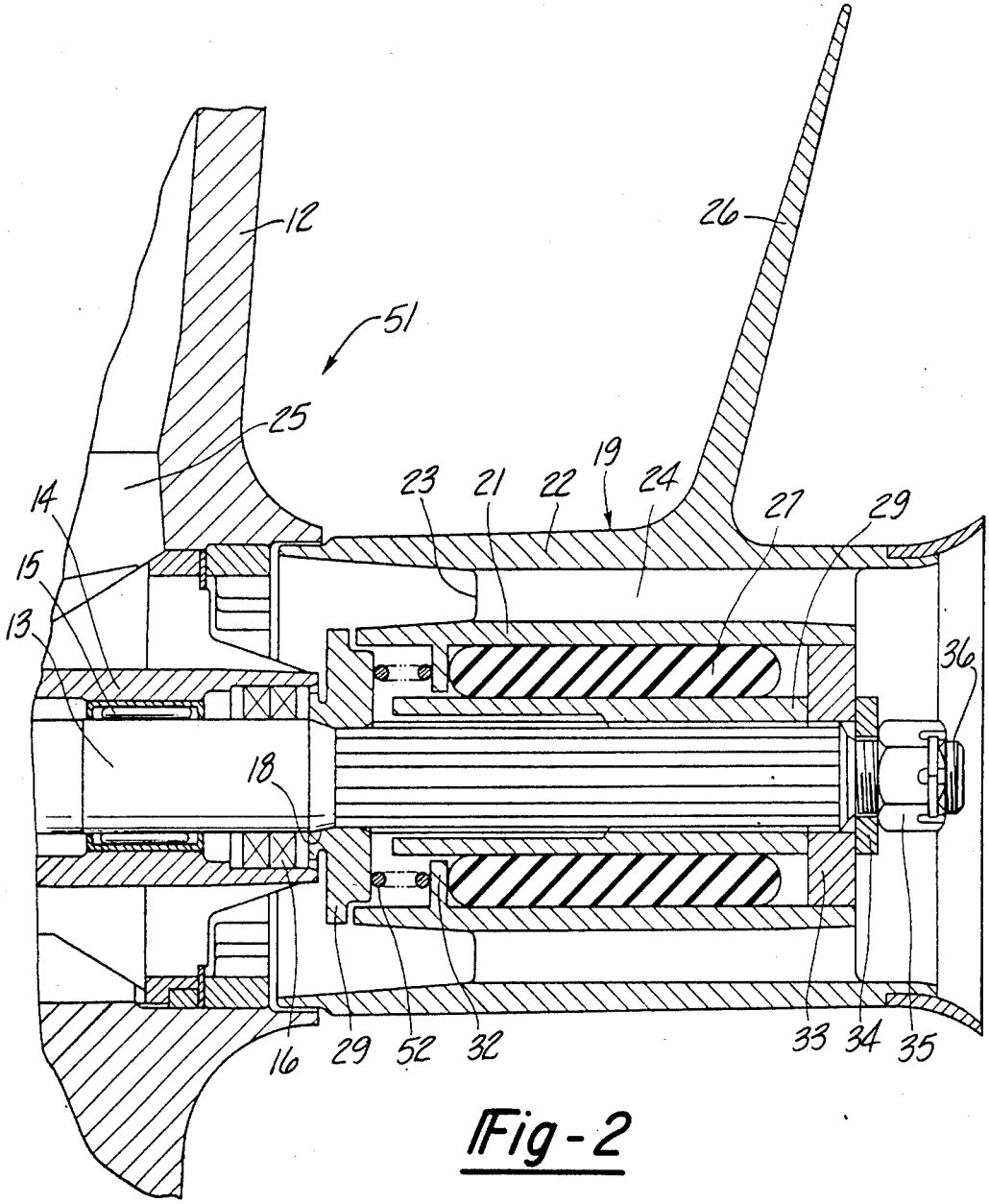
FIG. 2 is a cross-sectional view taken along a plane similar to FIG. 1 and shows another embodiment of the invention.

A second embodiment of the invention is illustrated in FIG. 2 and is identified generally by the reference numeral 51. The embodiment of FIG. 2 is substantially the same as the embodiment of FIG. 1, however, in this embodiment the second elastomeric member is replaced by a coil compression spring 52 that is interposed between the hub member flange 32 and the thrust member 29. Hence in this embodiment the axial damping will be accomplished by the spring 52 rather than an elastomeric number as in the previously described embodiment. As in the embodiment of FIG. 1, the inner sleeve 29 or inner hub member 21 or both may contact the thrust member 29 when the spring 52 has compressed sufficiently so as to take up the clearance and to decrease the effect of axial vibration dampening.

Figure 3:
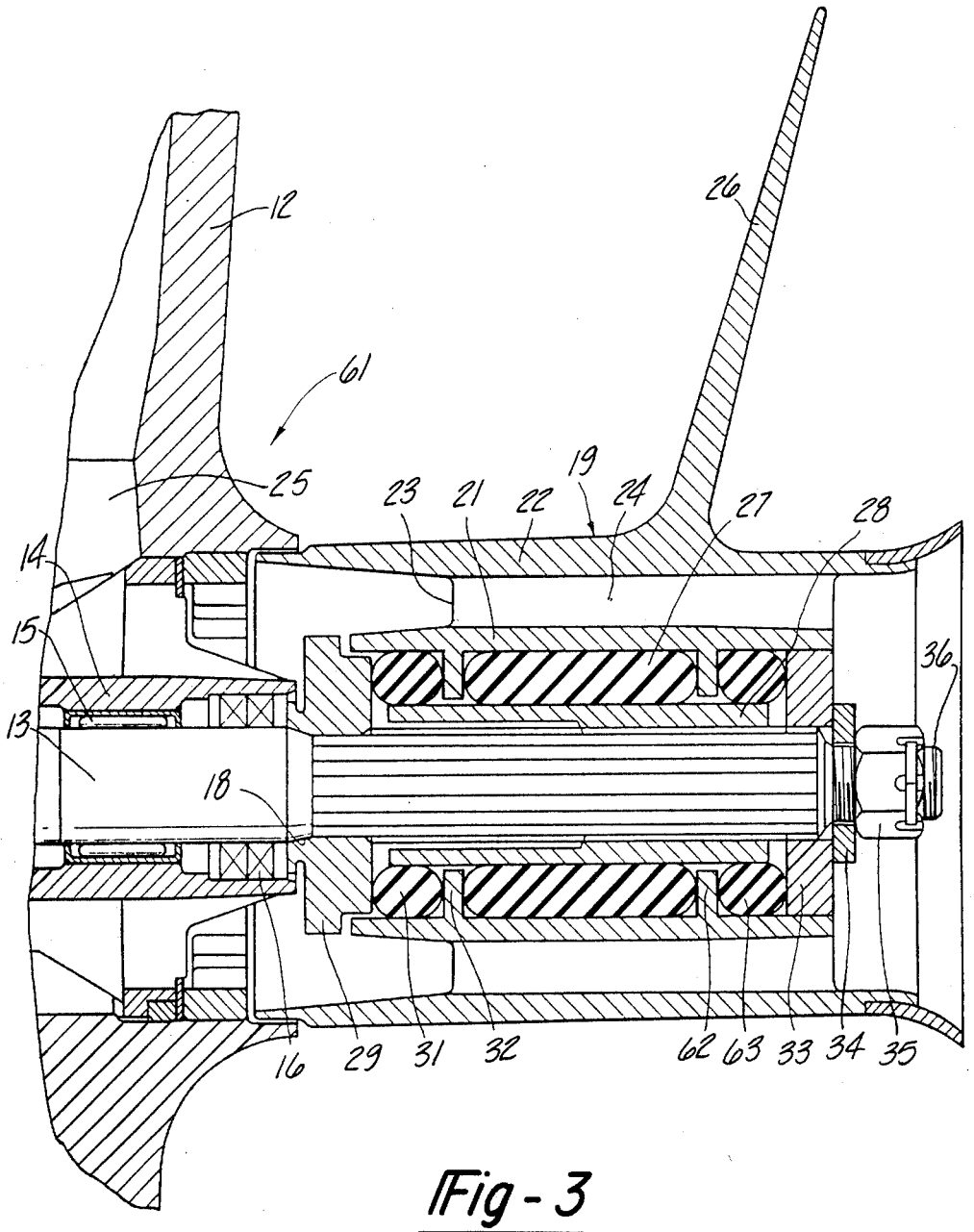
FIG. 3 is a cross-sectional view taken along a plane similar to FIGS. 1 and 2 and shows a third embodiment of the invention.

In FIG. 3, a still further embodiment of the invention is identified generally by the reference numeral 61. The embodiment of FIG. 3 is similar to the embodiment of FIG. 1, however, this embodiment also includes a damping mechanism for damping axial forces when driving in a rearward direction. Since the circumferential and forward axial dampening constructions are the same as that of FIG. 1, these components have been identified by the same reference numberals as used in FIG. 1 and will not be described again.

In this embodiment the circumferential elastomeric damper 27 is not as long as the corresponding damper of the embodiment of FIG. 1. Also, the inner sleeve 28 terminates at its rearward end forwardly of the reverse thrust member 33. The inner hub member 21 of the properller 19 is also formed with an inwardly extending circumferential flange 62 near its rear end. A third elastomeric member 62 is interposed between the flange 62 and the thrust member 33.

In this embodiment, when driving in a rearward or reverse direction, the elastomeric member 63 will absorb vibrations in the axial direction until it has deflected sufficiently so that the rear end of the inner sleeve 28 contacts the thrust member 33 and provides a direct mechanical connection which will eliminate the vibration damping in this direction. In all other regards this embodiment is the same as the previously described embodiments.

It should be readily apparent that the degree of vibration damping in all of the disclosed embodiments can be appropriately adjusted by changing the spring rates and clearances. It should be also readily apparent that the disclosed constructions can, as has been noted, be used with propellers not having through the hub exhaust. Various other changes and modifications may be made without departing from the spirit and scope of the invention, as defined by the appended claims.

I claim:

1. A marine drive comprising a propeller adapted to be coupled in driving relation with a driving shaft having a thrust member thereon for receiving driving thrusts, said propeller comprising a hub having at least one blade formed thereon, an inner sleeve adapted to be affixed against rotation relative to the driving shaft, and a coupling arrangement for coupling said propeller and said inner sleeve comprising first resilient means directly connected to said hub and said inner sleeve for providing a resilient connection in a circumferential direction between said propeller and the driving shaft, and second resilient means affixed at one end directly to said hub and adapted to engage the thrust member at its other end for providing a resilient connection between said propeller and the driving shaft in an axial direction.

2. A coupling arrangement in accordance with claim 1, wherein the resilient means have different rates.

3. A coupling arrangement in accordance with claim 2, wherein the second resilient means has a lower rate in the axial direction than the rate of the first resilient means in the circumferential direction.

4. A coupling arrangement in accordance with claim 1, further including positive stop means for limiting the degree of compression of the second resilient means in the axial direction.

5. A coupling arrangement in accordance with claim 4, wherein the positive stop means comprises engaging surfaces on the thrust member and on the hub, the surface of the hub being normally spaced from the surface of the thrust member, said surfaces being adapted to engage upon a predetermined degree of compression of the second resilient means.

6. A coupling arrangement in accordance with claim 5, wherein the engaging surfaces are annular.

7. A coupling arrangement in accordance with claim 6, wherein the first and second resilient means are elastomeric sleeves.

8. A coupling arrangement in accordance with claim 6, wherein the first resilient means is an elastomeric sleeve and the second resilient means is a coil spring.

9. A coupling arrangement in accordance with claim 1, wherein the first and second resilient means are elastomeric sleeves.

10. A coupling arrangement in accordance with claim 1, wherein the first resilient means is an elastomeric sleeve and the second resilient means is a coil spring.

11. A coupling arrangement in accordance with claim 1, wherein the second resilient means provides a resilient connection in a first axial direction and further including third resilient means for providing a resilient connection between the propeller and the driving shaft in the opposite axial direction.

12. A coupling arrangement for resiliently coupling a propeller and a driving shaft comprising a propeller hub having a bore formed therein, an inner sleeve having a spline connection to said driving shaft and having an outer surface spaced radially inwardly from the bore of said propeller hub, a first elastomeric sleeve resiliently coupling said propeller hub and said inner sleeve, a thrust taking member affixed to said driving shaft, said thrust taking member and at least one of said hub and said inner sleeve having axially spaced surfaces, an inwardly extending annular flange formed on said propeller hub and extending into its bore and resilient means axially interposed between said annular flange of said propeller hub and said thrust taking member for absorbing axial forces therebetween, said surfaces being adapted to engage each other for providing positive thrust transmission when said resilient means compresses more than a predetermined amount.

13. A coupling arrangement in accordance with claim 12, wherein the resilient means comprises a second elastomeric member.

14. A coupling arrangement in accordance with claim 12, further including second resilient means interposed between the propeller hub and a reverse thrust taking member affixed to the driving shaft whereby said second resilient means absorbs axial thrust in the reverse drive direction.

15. A coupling arrangement in accordance with claim 14, wherein the first and second resilient means comprise second and third elastomeric members.

* * * * *